US006464417B2

(12) United States Patent
Barbera et al.

(10) Patent No.: US 6,464,417 B2
(45) Date of Patent: Oct. 15, 2002

(54) METHOD AND APPARATUS FOR PRINT MEDIA DETECTION

(75) Inventors: Joseph D. Barbera, LaCenter, WA (US); Babak Honaryar, Carlsbad, CA (US); William T. Jennings, Vancouver, WA (US); Pierre J. Kaiser, Vancouver, WA (US); Kieran B. Kelly, Vancouver, WA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 10/021,415

(22) Filed: Dec. 11, 2001

(65) Prior Publication Data

US 2002/0044813 A1 Apr. 18, 2002

Related U.S. Application Data

(62) Division of application No. 09/470,812, filed on Dec. 22, 1999, now Pat. No. 6,364,556.

(51) Int. Cl.[7] ..... B41J 29/42

(52) U.S. Cl. ..... 400/711; 400/703; 400/708

(58) Field of Search ..... 400/711, 708, 400/706, 703; 271/258.01, 258.03, 262, 3.15, 3.17; 226/45; 250/559.29, 559.36, 559.4

(56) References Cited

U.S. PATENT DOCUMENTS

| | | | | |
|---|---|---|---|---|
| 5,169,240 A | * | 12/1992 | Bobo et al. | 400/706 |
| 5,927,703 A | * | 7/1999 | Endo | 271/10.03 |
| 6,151,117 A | * | 11/2000 | Tuhro et al. | 250/559.29 |
| 6,212,130 B1 | * | 4/2001 | Brazeal et al. | 271/258.01 |
| 6,237,847 B1 | * | 5/2001 | Milne | 235/379 |

* cited by examiner

*Primary Examiner*—Ren Yan
*Assistant Examiner*—Minh Chau

(57) ABSTRACT

A multi-purpose, transmissive paper sensor includes a light beam projector and light detector having an analog output signal. Changes in the output signal from an open loop condition indicate the presences of at least one print medium being in the field-of-view of the sensor. Output signals indicative of print media leading edge, trailing edge, and number of sheets interrupting the light beam provide improved print media transport control for hard copy apparatus.

3 Claims, 7 Drawing Sheets

METHOD AND APPARATUS FOR PRINT MEDIA DETECTION

CROSS REFERENCE TO RELATED APPLICATION(S)

This is a divisional now U.S. Pat. No. 6,364,556 of application Ser. No. 09/470,812 field on Dec. 22, 1999, which is hereby incorporated by reference herein.

BACKGROUND OF THE INVENTION

1. Field of the Invention

The present invention relates generally to hard copy apparatus, more particularly to print media sensing and, more specifically, to a transmissive optical sensing method and apparatus for print media sheet recognition.

2. Description of the Related Art

In designing paper path for hard copy apparatus, a designer must address the problem of print media (hereinafter referred to generically as "paper," regardless of form, e.g., plain paper, special media, envelopes, and the like as would be common to the state of the art) recognition and positioning, multiple sheet picks, and transport to and through the printing zone. It is rare that multiple sheet picks present perfectly registered sheets of paper where a printing error—generally print registration on the page—will not occur. Therefore, when multiple sheets are overlapped, state of the art paper length sensing devices generally indicate a single sheet that is longer than the actual media in the input supply because the commonly used optical detectors or opto-mechanical interrupters inherently do not have the capability to sense the presence of two overlapped sheets of paper since the overlapped region between the two sheets generates the same signal as a single sheet. Exemplary optical media sensing methods and apparatus are shown in U.S. Pat. No. 5,135,321 (Olsen et al.), U.S. Pat. No. 5,466,079 (Quintana) and its divisional, U.S. Pat. No. 5,564,848 (each assigned to the common assignee herein and incorporated by reference in their entireties).

Multiple sheet picks effect a throughput loss as any print is likely to be mis-registered, requiring a reprinting.

There is a need for a method and apparatus which has the capability to view overlapped print media as being different than a single sheet. Moreover, such an apparatus is useful in the detection of top-of-form and bottom-of-form in the feeding and transport of multi-page printed form sheets are being fed and small overlaps are intentional. Furthermore, such an apparatus is useful in detecting the gap length between tail-gating sheets of paper.

SUMMARY OF THE INVENTION

In a basic aspect, the present invention provides a print media sensor device, including: mounted for bracketing a print media transport path, at least one emitter for directing a light beam across the transport path, the light beam having predetermined intensity and wavelength for penetrating print media, and aligned with the emitter, receptor mechanisms for receiving the light beam, wherein the receptor mechanisms provides a first output signal indicative of no paper breaking the beam, a second output signal indicative of a single sheet of print media interrupting the beam, and at least one other signal level indicative of multiple sheets of print media interrupting the beam.

Another basic aspect of the invention is a method of detecting print media in a print media path, including the steps of: positioning a transmissive light sensor along the print media path; calibrating the sensor for providing a first signal indicative of no print media within the field-of-view of the sensor, a second signal indicative of one sheet of print media being within the field-of-view of the sensor, and at least a third signal indicative of multiple sheets of print media being with the field-of-view of the sensor, wherein a change from the first signal is also indicative of a leading edge position of the print media in the print media path and a change from the second signal to the first sign is indicative of a trailing edge position of the print media in the print media path.

Another basic aspect of the present invention is a hard copy apparatus having a predefined paper path including a region upstream of a printing zone of the apparatus, associated with the printing zone, mechanisms for printing on paper, mechanisms for transporting paper from an upstream side of printing zone to an input of the printing zone, and paper position detector and indicator mechanisms, the mechanisms including: aligned with respect to associated with the predefined paper path region, a sensor having at least one light transmitter and at least one light receptor respectively positioned bracketing a predetermined position of the region, wherein the receptor provides signals indicative of conditions within the paper path including a first signal indicative of no print media within the field-of-view of the sensor, a second signal indicative of one sheet of print media being within the field-of-view of the sensor, and at least a third signal indicative of multiple sheets of print media being with the field-of-view of the sensor, and wherein a change from the first signal is also indicative of a leading edge position of the print media in the print media path in the field-of-view and a change from the second signal to the first signal is indicative of a trailing edge position of the print media in the print media path within the field-of-view.

Some of the advantages of the present invention are:

- it provides an substantially immediate detection of a multiple print media sheet pick;
- it provides leading edge and trailing edge detection;
- it provides a means for top-of-form and bottom-of-form detection;
- it provides improvement in media edge detection for full-bleed printing; and
- it provides for improvements to hard copy apparatus throughput.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01 (d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference Other objects, features and advantages of the present invention will become apparent upon consideration of the following detailed description and the accompanying drawings, in which like reference designations represent like features throughout the figures.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventors for practicing the invention. Alternative embodiments are also briefly described as applicable.

Figure 1:
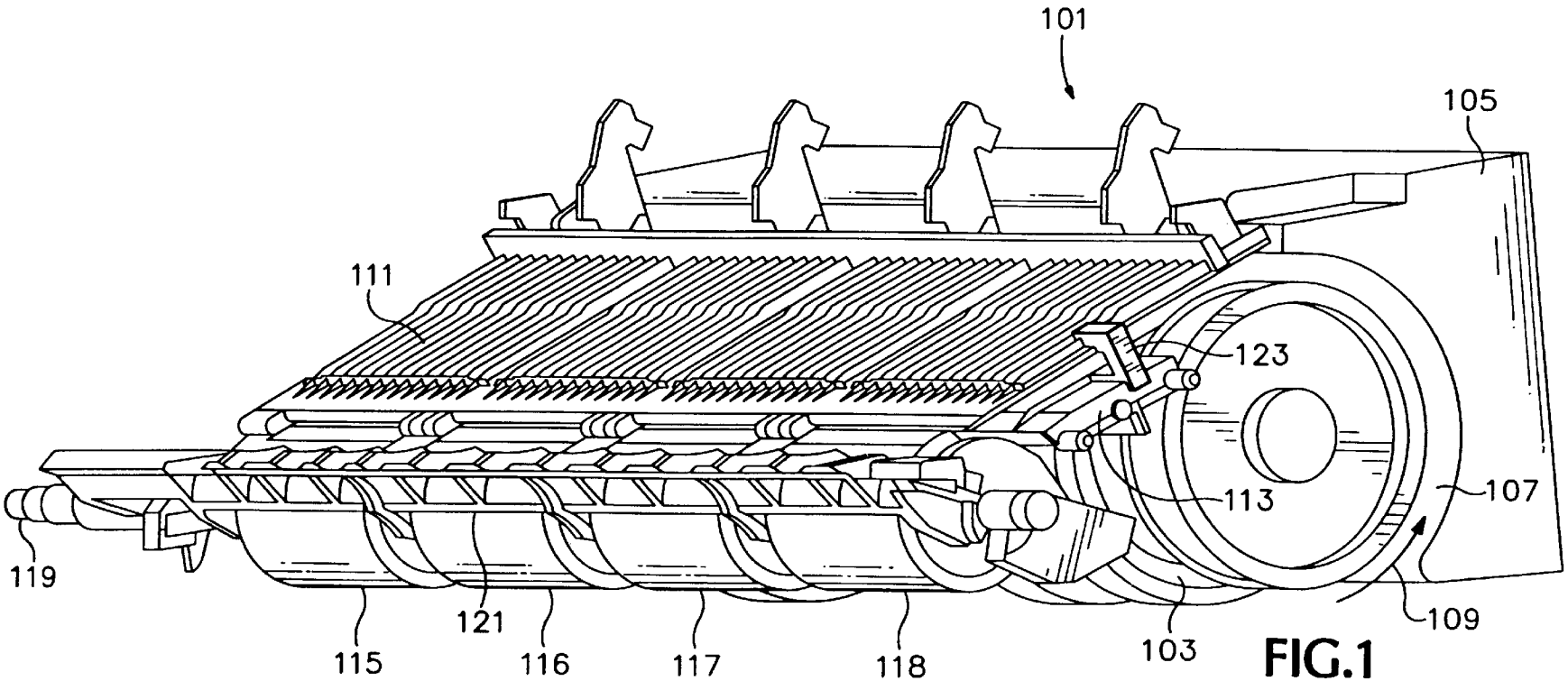
FIG. 1 is a perspective view drawing of a paper transport mechanism for a hard copy apparatus in accordance with the present invention.

FIG. 1 depicts an exemplary embodiment paper transport mechanism 101 for a hard copy apparatus. Many such mechanisms are well-known in the art; the implementation shown is for convenience in explaining the present invention which is associated with the paper transport mechanism and no limitation on the scope of the invention is intended by the inventors nor should any be implied from the specifics of this example. The transport mechanism 101 is suitably mounted within the hard copy apparatus adjacent a supply of paper (not shown), such as would be placed by the end user in an input tray. In this mechanism, at least one pick roller 103 proximate the input tray is designed for appropriately picking a sheet and transporting it along a paper path initially determined by a rear paper guide 105. Assuming the input tray is subjacent the pick roller 103, rotating the pick roller counter-clockwise transports a picked sheet—or in a double pick, both sheets—such that a first leading edge is driven along the curvilinear surface 107 in the direction indicated by arrow 109, used hereinafter to generally represent the paper path through the transport mechanism 101.

Following the curvilinear surface 107, the picked sheet will make a one-hundred and eighty degree turn about the pick roller 103 and then the leading edge will next encounter an upper paper guide 111. The paper path then assumes a more linear transport mechanism region as the sheet is directed between the upper paper guide 111 and a lower paper guide 113. As the leading edge of the sheet exits the linear transport region of the paper path, it will be engaged by axle 119 driven feed rollers 115, 116, 117, 118 which will deliver the sheet across a pivot 121 to the printing zone of the hard copy apparatus. A paper sensor 123 is positioned in the linear transport region of the paper path.

Figure 2:
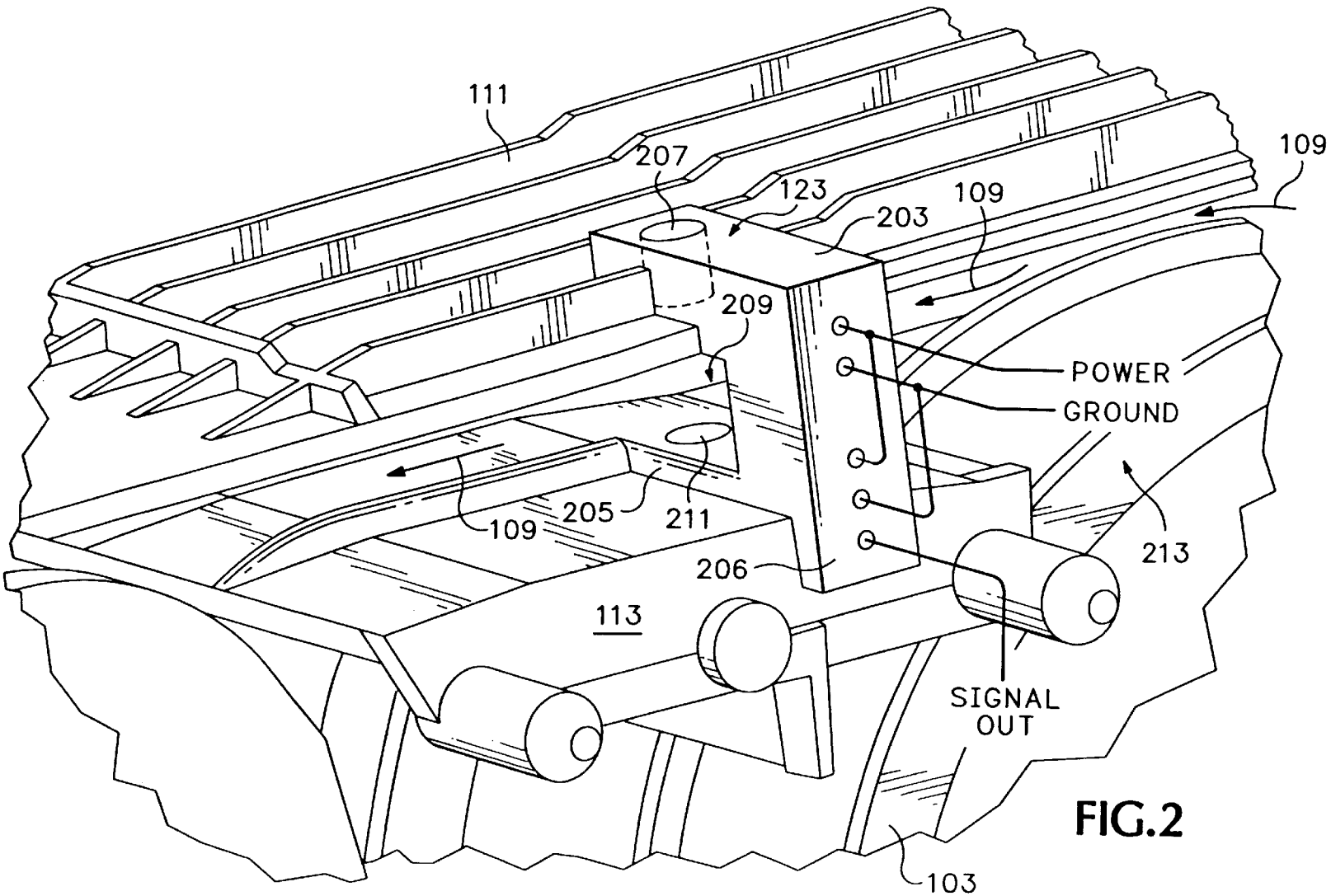
FIG. 2 is a close-up detail from FIG. 1 highlighting the detector.

Turning now to FIG. 2, the sensor 123 device in accordance with the present invention is illustrated in further detail. A paper path bracket 201 has upper arm 203 and lower arm 205 members that extend laterally from an upright 206 with the upper arm 203 extending over the paper path (again indicated by arrows 109) and the lower arm 205 extending under the paper path such that at least one side edge of a sheet of paper will pass through the bracket 201 as a sheet is transported along the paper path linear region. In other words, the bracket 201 generally forms a "C" in which the open cavity 209 formed by the arms 203, 205 is in the paper path.

An optical emitter 207, such as a light emitting diode ("LED") is mounted on the upper arm 203 to project a light beam across the paper path. A photo-receptor 211, having an analog output, is mounted on the lower arm 205 in visual alignment with the emitter 207 for detecting the light beam projected across the paper path. Commercially available LED and photo-receptor elements can be employed in the present invention. These elements can be selected or tailored to any specific implementation. Selection or design is based on the wavelength and intensity of light needed for the various forms of paper used with the printer. The LED has to have an output beam capable of penetrating at least two sheets of the densest media used in the hard copy apparatus. Standard electrical connections 213 are provided for "POWER," "GROUND," and "SIGNAL OUT."

As can now be recognized, by using an emitter on one side of a sheet of paper in the paper path paired with a photo-receptor capable of an analog output on the opposite side of the paper, the output of the photodiode will give an indication of the total light that is being transmitted across the paper path. Two sheets of paper in the path simultaneously will theoretically transmit less light than a single sheet of paper which in turn transmits significantly less light than when no sheet is present. In general, the actual levels will be a function of wavelength and intensity of the particular LED subsystem employed in a specific implementation. Thus, at least three distinct output signal levels are detectable, corresponding to the state of 0, 1 or 2 sheets of paper at a given point in the paper path. This output signals are thus indicative of a multiple-pick or, if appropriate to the current print job to measure the relationship of the top-of-form and bottom-of-form positions of intentionally overlapped pages.

Figure 3:
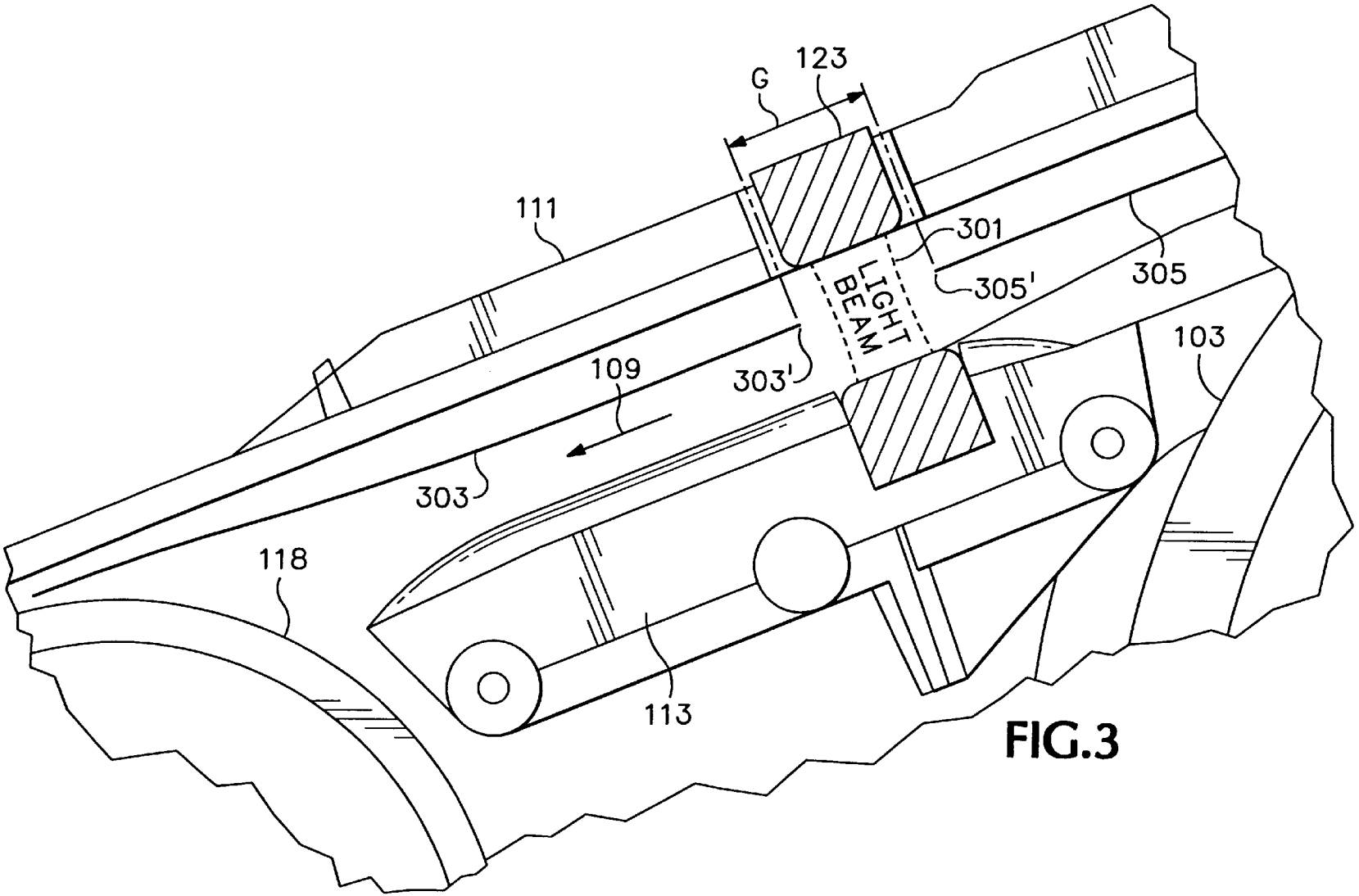
FIG. 3 is an close-up detail from FIG. 1 in an elevation view, showing a case of two sheets of media and a gap between the trailing edge of one and the leading edge of the other.
Figure 6:
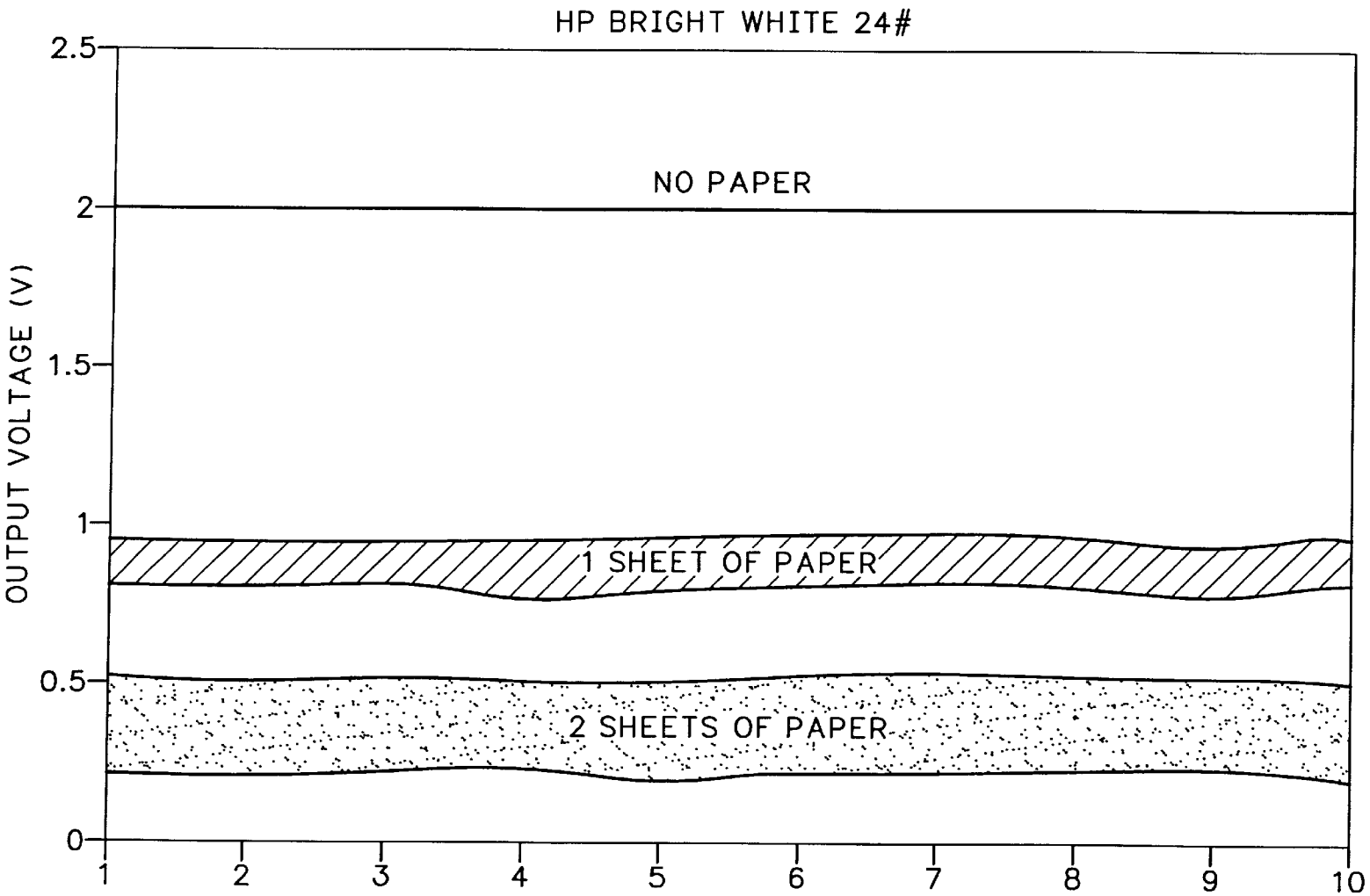
FIG. 6 is a graph showing exemplary measurements in accordance with the present invention.

This is illustrated by the graph of FIG. 6; this data of this graph was empirically generated as an example of operation of the present invention using the invention with HP™ bright white, twenty four pound paper; the implementation shown is for convenience in explaining the present invention which is associated with the paper transport mechanism and no limitation on the scope of the invention is intended by the inventors nor should any be implied from this example. Looking also to FIGS. 3 (showing two separated paper sheets, appropriately picked and traversing the paper path) and 4 (a multi-pick condition), when no paper is in the light beam 301 the full intensity of the light hits the photo-receptor of the sensor 123 device when the gap, "G," between a first sheet 303 and a second sheet 305 in the paper path 109 passes the sensor. An output voltage—or other state indicator signal, "Signal Out," FIG. 2, as would be known in the art—is generated by the photo-receptor 211 of the sensor 123, shown in FIG. 6 as an exemplary, calibrated, two-volt signal, "No Paper." It has been found that even when the gap, G, is reduced to zero, where the trailing edge 303' of the leading sheet 303 appears to be touched by the leading edge 305' of a trailing sheet 305, a spike signal Signal Out (FIG. 2) Output Voltage (FIG. 6) generally will be sent by the photo-receptor. Thus the sensor 123 acts as a leading edge-trailing edge detector.

As a single sheet passes through the sensor 123, less light is received at the photo-receptor 211. In the example, where the open loop condition Signal Out is two volts, the intensity falls into a first range ("1 Sheet of Paper") of approximately 0.8 to 0.9 volts, or approximately half the open loop, "No Paper," condition.

Figure 4:
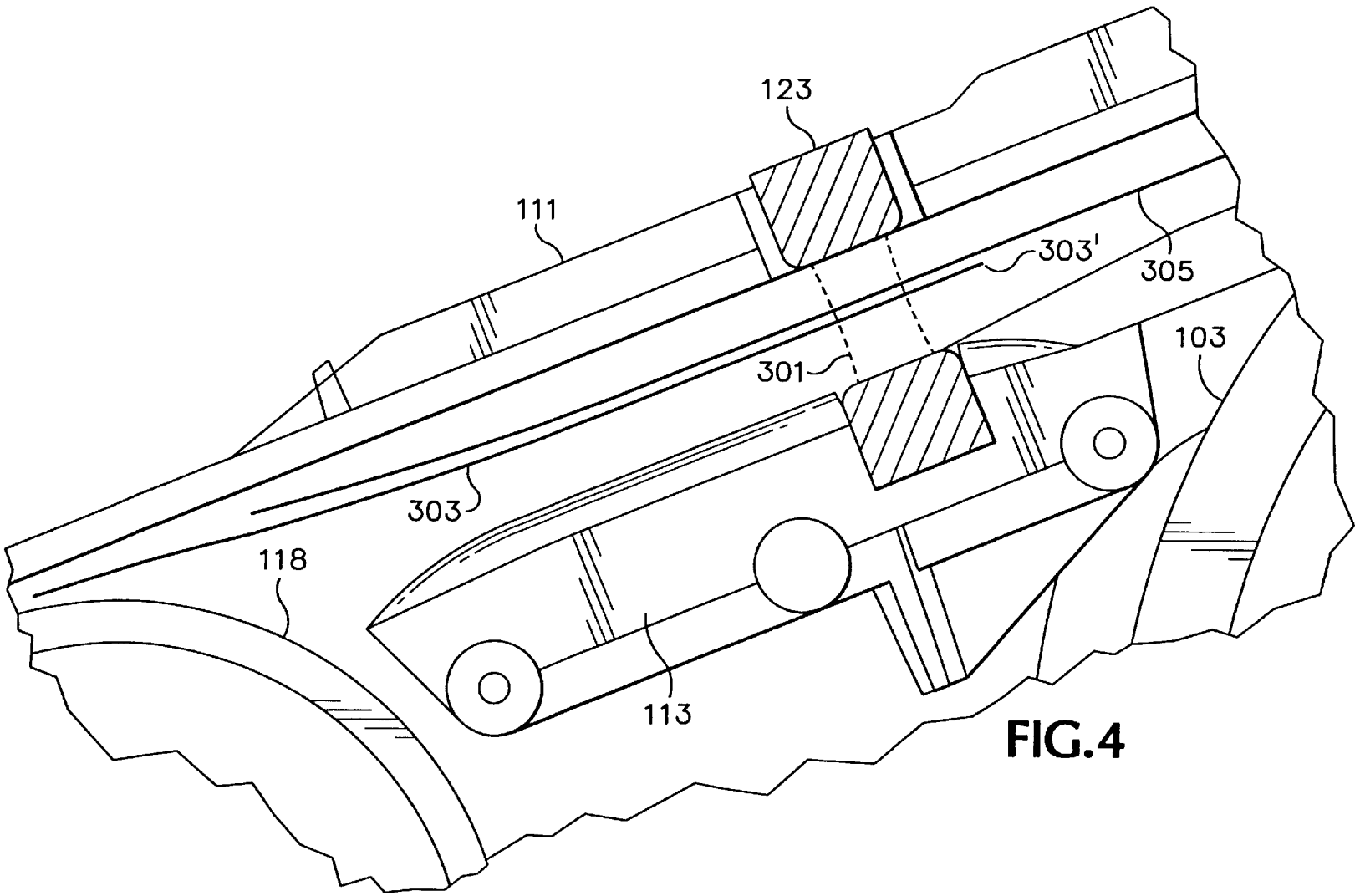
FIG. 4 is a close-up detail as shown in FIG. 3, showing a case of two sheets of media and an overlap between the trailing edge of one and the leading edge of the other.

Turning also to FIG. 4, a multi-pick condition is illustrated. In the exemplary measurement chart of FIG. 6, when two (or more) sheets overlap in the sensor 123 region of the paper path, the Output Voltage drops to a range of approximately 0.2 volts to 0.5 volts. A triple pick would result in a lower Signal Out.

Thus the sensor acts as a multi-pick detector. Rather than printing downstream of the transport 101, an eject cycle—or other action as will be explained with respect to FIG. 7—can be initiated, simultaneously including the next pick if appropriate.

Figure 7:
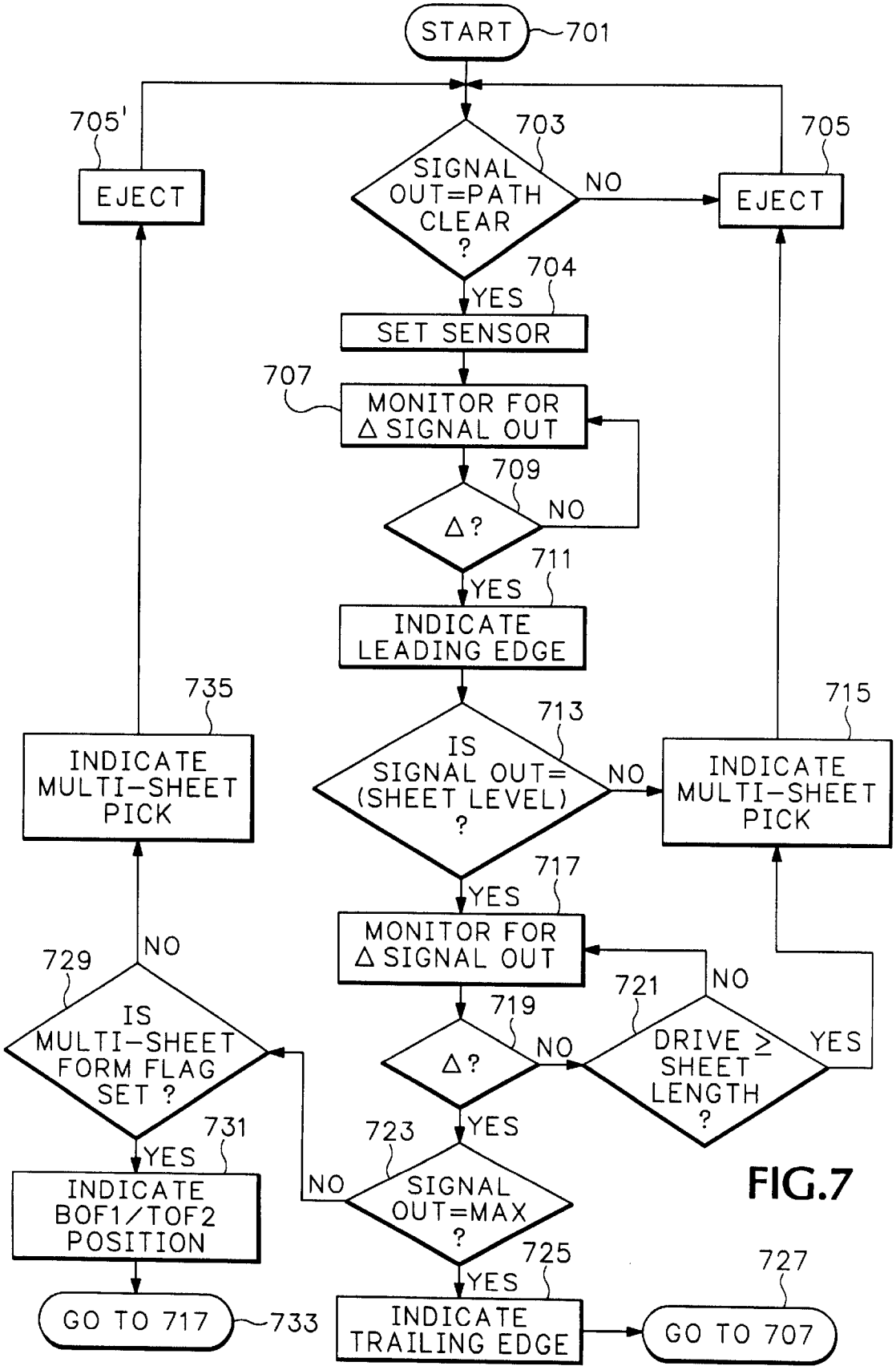
FIG. 7 is a flow chart of the operation of the present invention in accordance with FIGS. 1–4.

The operation is illustrated by the flow chart of FIG. 7, with cross-references to the hardware of the other FIGS.. The operational cycle begins with a print job (or during calibration phase in a power-on or a hard copy apparatus device driver boot-up routine as would be known in the art), step 701. The Signal Out from the photo-receptor 211 should be at its calibrated maximum, No Paper, level, step 703. If not, the eject cycle, step 705, can be implemented to clear the paper path. If no paper sheet was in the paper path, a recalibration of the No Paper level can be instituted, re-setting the sensor to its appropriate design range or trouble-shooting routine can be implemented as needed and as would be known in the art of device driver software; further discussion here is not essential to an understanding of the present invention. If the paper path is clear, step 703, YES-path, the sensor device is set to the appropriate, calibrated, detecting range level, step 704, and monitoring of the Signal Out is instituted, step 707. When a Signal Out change occurs, it is assumed that a next sheet of paper is being transported along the paper path 109 and that the leading edge is breaking the light beam 301 and a position indicator signal is sent to the device driver, step 711, and used in transporting the sheet through the printing zone. If the substantially immediate Signal Out is not indicative of a single sheet (FIG. 6, 1 Sheet of Paper range), step 713, an error has occurred, assumed to be a multi-pick, and the sheets are ejected, step 705.

Another condition may call for an immediate ejection of a sheet. The device driver software will know the expected length of the sheet and the time it takes to print that page. Thus, during monitoring, step 717, after recognition of a leading edge, a change in Signal Out, step 719, is expected at an approximate predetermined time. If that time is exceeded, step 721, YES-path, an error is assumed and the eject cycle initiated, step 705.

In a normal situation, the Signal Out is appropriate to one sheet in the paper path 109. Monitoring of the Signal Out for a change continues, step 717. When a signal change occurs such that Signal Out transitions to the No Paper maximum level, step 723, YES-path, a trailing edge position indicator is set, step 725, and the information sent to the device driver. The cycle continues by returning, step 727, to monitoring, step 707, for the next leading edge.

The operation is complicated by the use of multi-sheet forms which use an intentional overlap to continuously print from the bottom-of-form-1 to the following top-of-form-2. The overlap will cause the Signal Out to drop to the lower "2 Sheets of Paper" (FIG. 6) range, but no error has occurred. Thus, the Signal Out change may transition from "1 Sheet of Paper" to "2 Sheets of Paper at a predetermined time significantly later than the indication of a leading edge, step 711. Thus, if the Signal Out indicates at this change and the multi-sheet form flag is set, step 729, YES-path, an indicator of the bottom-of-form-1 to the top-of-form-2, step 731, is sent to the device driver. The process continues, step 733, by monitoring, step 717, for the next transition—possibly to a "3 Sheets of Paper" level, et seq.—until a trailing edge recognition, steps 719, 723, 725, 727, sequence occurs. If at the test step 723 for the changed signal level is followed by a recognition that a multi-sheet form was not expected (step 729, NO-path), an indication that a multi-sheet pick error occurred triggers the eject cycle, step 705'.

It should be noted by those skilled in the art that self-calibrating of the "No Paper," FIG. 6, level can be implemented to account for the use of different types of media, such as by feeding a sheet of the next media to be used—e.g., a thicker photo-quality paper used in color ink-jet printing—and adjusting the multiple pick levels recognition accordingly.

Figure 5:
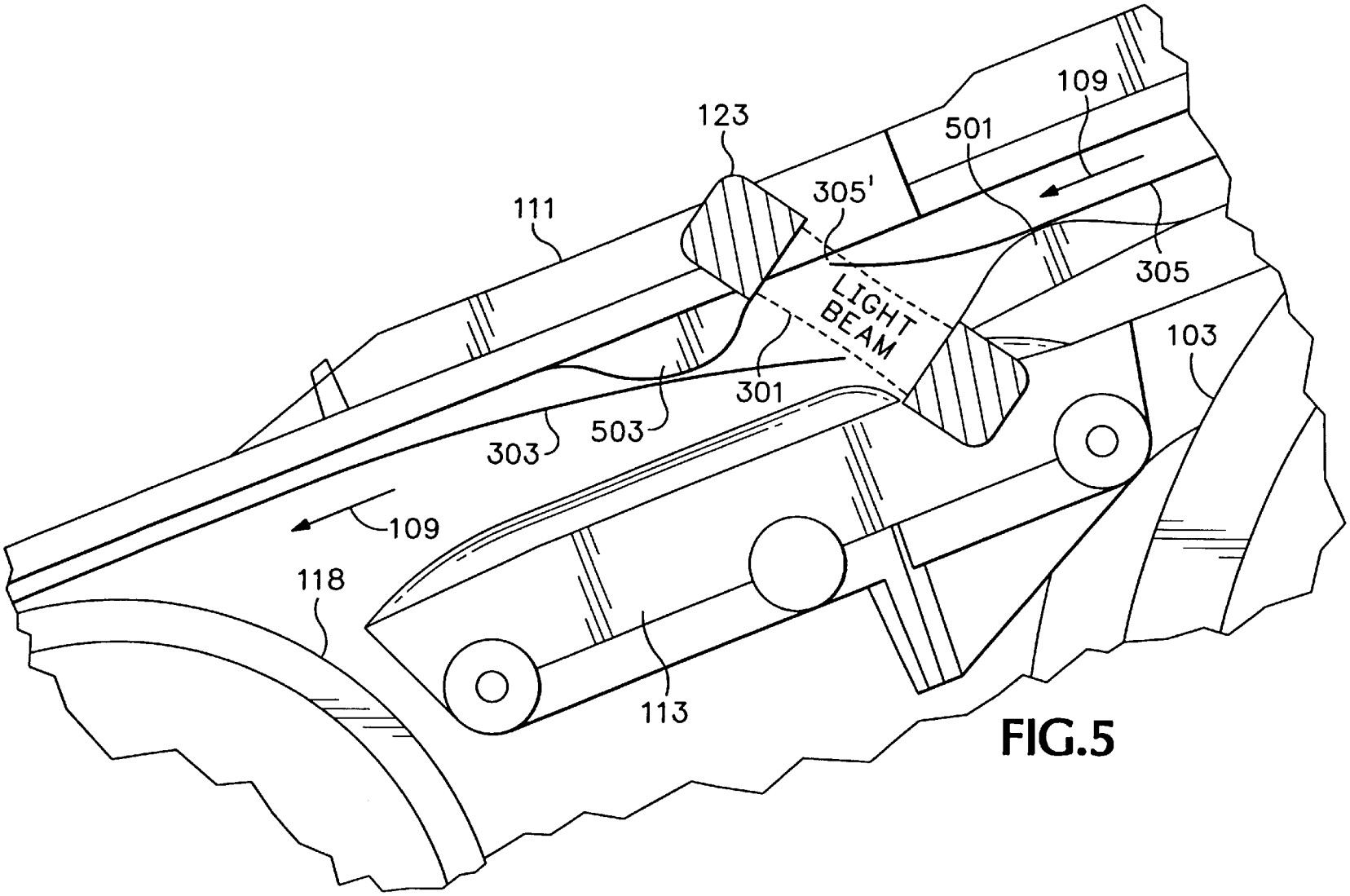
FIG. 5 is an alternative embodiment of the present invention as shown in FIGS. 1 through 4.

An alternative and preferred embodiment of the present invention is shown in FIG. 5. The sensor 123 is mounted an angle to the paper path 109. The upper paper guide 111 and the lower paper guide 113 are provided with protrusions 501, 503 into the paper path 109; smooth transition bumps prevent binding of the leading edge 305' of a paper sheet 305 through the field-of-view of the sensor 123. The lower guide protrusion 501 is located just upstream of the sensor and the upper guide protrusion 503 is located just downstream of the sensor. Note that the protrusions can be a single construct proximate the sensor 123 or a series of bumps (or ramps or the like as is expedient for a particular design) or a continuous construct across the upper and lower guides 111, 113 as best suits a particular implementation. As demonstrated in FIG. 5, the upstream protrusion lifts the leading edge of a sheet 305; the downstream protrusion drops the trailing edge of a preceding sheet 303. By doing so, the light beam 301 is ensured a clear transmissive gap between the emitter and receptor, yet still recognizes multiple picked sheet errors or intentionally overlapped sheets in the same operational manner as already described.

It will also be recognized by those skilled in the art that the transmissive sensor 123 device can be built into upper and lower guides 111, 113 or be mounted elsewhere upstream of the printing zone of the hard copy apparatus.

Furthermore, an implementation having a plurality of emitters and detectors may also be employed.

The foregoing description of the embodiments of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase: "means for. . . ."

What is claimed is:

1. A hard copy apparatus having a predefined paper path including a region upstream of a printing zone of the apparatus, associated with the printing zone, means for printing on paper, means for transporting paper from an upstream side of printing zone to an input of the printing zone, and paper position detector and indicator mechanisms, the mechanisms comprising:

aligned with respect to associated with the predefined paper path region, a sensor having at least one light transmitter and at least one light receptor respectively positioned bracketing a predetermined position of the region, wherein the receptor provides signals indicative of conditions within the paper path including a first signal indicative of no print media within the field-of-view of the sensor, a second signal indicative of one sheet of print media being within the field-of-view of the sensor, and at least a third signal indicative of multiple sheets of print media being with the field-of-view of the sensor, and wherein a change from the first signal is also indicative of a leading edge position of the print media in the print media path in the field-of-view and a change from the second signal to the first signal is indicative of a trailing edge position of the print media in the print media path within the field-of-view; and means in the paper path for altering the gap between the trailing edge of a first sheet of paper in the paper path and the leading edge of a following sheet of paper in the paper path.

2. The apparatus as set forth in claim 1, comprising:

the receptor provides an analog output signal representative of the number of sheets of paper in the paper path substantially instantaneously interrupting the light transmitted by the transmitter.

3. The apparatus as set forth in claim 1, comprising:

providing the paper path with at least one protrusion means for deflecting an edge of the print media proximate the sensor.

* * * * *